US006440224B1

(12) United States Patent
Wei et al.

(10) Patent No.: US 6,440,224 B1
(45) Date of Patent: Aug. 27, 2002

(54) HYDROFLUORIC ACID GENERATING COMPOSITION AND METHOD OF TREATING SURFACES

(75) Inventors: Guang-jong Jason Wei, Mendota Heights; David Daniel McSherry, Minneapolis; Mark D. Levitt, St. Paul, all of MN (US)

(73) Assignee: Ecolab Inc., St, Paul, MN (US)

( * ) Notice: Subject to any disclaimer, the term of this patent is extended or adjusted under 35 U.S.C. 154(b) by 0 days.

(21) Appl. No.: 09/268,010

(22) Filed: Mar. 15, 1999

(51) Int. Cl.[7] ..... C23G 1/02

(52) U.S. Cl. ..... 134/3; 134/2; 134/26; 134/28; 134/34; 134/36; 134/41; 134/902; 510/245; 510/254; 510/257; 423/483; 423/484; 423/485; 423/488

(58) Field of Search ..... 134/2, 3, 26, 28, 134/34, 36, 41, 902; 510/245, 254, 257; 423/483, 484, 485, 488

(56) References Cited

U.S. PATENT DOCUMENTS

| | | | | | |
|---|---|---|---|---|---|
| 2,625,468 | A | | 1/1953 | Prance et al. | 41/42 |
| 2,687,346 | A | | 8/1954 | McDonald | 41/42 |
| 2,729,551 | A | | 1/1956 | Cohn | 41/42 |
| 3,009,849 | A | | 11/1961 | Bellinger | 156/21 |
| 3,094,489 | A | | 6/1963 | Barnes | 252/79.2 |
| 3,119,726 | A | | 1/1964 | King et al. | 156/19 |
| 3,326,803 | A | | 6/1967 | Kelly et al. | 252/79.4 |
| 3,878,294 | A | * | 4/1975 | Schabacher et al. | 423/485 |
| 4,067,957 | A | * | 1/1978 | Worthington et al. | 423/484 |
| 4,078,047 | A | * | 3/1978 | Spreckelmeyer | 423/485 |
| 4,477,425 | A | * | 10/1984 | Berry et al. | 423/485 |
| 4,496,466 | A | | 1/1985 | Whitehurst et al. | 252/79.3 |
| 4,882,134 | A | * | 11/1989 | Mizrahi | 423/356 |
| 5,417,819 | A | | 5/1995 | Askin et al. | 204/129.1 |
| 5,722,442 | A | * | 3/1998 | Hoffman et al. | 134/102.1 |
| 5,972,123 | A | * | 10/1999 | Verhaverbeke | 134/3 |

FOREIGN PATENT DOCUMENTS

| | | |
|---|---|---|
| GB | 2159136 | * 11/1985 |

* cited by examiner

*Primary Examiner*—Sharidan Carrillo
(74) *Attorney, Agent, or Firm*—Merchant & Gould P.C.

(57) ABSTRACT

A method of treating a surface of a metal is provided. A source of fluoride ion is mixed with a source of acid to form hydrofluoric acid and, when applied to a metal surface to be treated, the hydrofluoric acid acts as a brightening agent.

9 Claims, 3 Drawing Sheets

HYDROFLUORIC ACID GENERATING COMPOSITION AND METHOD OF TREATING SURFACES

BACKGROUND OF THE INVENTION

1. Field of the Invention

The present invention relates to the field of cleaning or brightening compositions, particularly to such compositions for use on metal surfaces, and more particularly to hydrofluoric acid generating compositions which are used in metal surface treating processes.

2. Background of the Art

It is desirable to have most metal surfaces presented as a highly reflective, shiny surface, for either aesthetic benefits or for functional benefits or both. The first methods for polishing or shining the surfaces of metal were physical treatments, where abrasive surfaces or abrasive materials were rubbed against the surface of the metals to render the surface more smooth and therefore more reflective. The durability of the shininess of a metal surface varied from metal to metal because of the oxidative reactivity of the metal, or its resistance to corrosion. It is not commercially feasible to repeatedly mechanically polish surfaces to maintain their brightness, as this tends to be labor intensive, abrades the surface (removing materials and shortening the effective structural life of the article), and is very inefficient on large surfaces such as vehicles (planes, cars, trucks, snowmobiles, boats, personal water vehicles, and the like). To that end, chemical washing and polishing compositions have been developed.

There are many different types of deposits and corrosion which can accumulate on metal surfaces, particularly where those surfaces are on vehicles. These deposits can also vary from location to location and from season to season as different chemicals and environmental conditions contribute to the different depositing or corroding materials. It is therefore necessary to provide a chemical composition in liquid form which has strong corrosion and film removal properties. This can make surface treatment a complex process for a number of different reasons.

The cleaning or brightening solutions must be sufficiently strong to remove unwanted materials but not be so strong as to damage the underlying metal surface. Very strong solvents and strong reducing or oxidizing agents may also be potentially dangerous to workers and handlers, so that containing of the solutions prior to application and protection of workers during application is important.

Hydrofluoric acid is an example of a very strong chemical used to brighten metals, especially in brightening aluminum or aluminum alloys. As shown in U.S. Pat. No. 2,687,346 aluminum and aluminum alloy surfaces on aircraft have been polished with hydrofluoric acid or hydrofluoric acid compounds. The composition of this patent particularly describes a composition which resists flowing and therefore reduces streaking of the surface of the metal by combining the hydrofluoric acid or hydrofluoric acid material with a polystyrene sulfonic acid. A sequestering agent my also be included in the composition to maintain in the cleaning solution any aluminum compounds or complexes formed in the cleaning treatment. Organic sequestering agents such as citric acid, tartaric acid, gluconic acid, and glucono delta lactone, and their ammonium salts are described. The hydrofluoric acid compound may be provided conveniently and preferably as ammonium acid fluoride both for the ease in handling the acid salt (as compared to HF itself) and for the additional contribution of the ammonium.

U.S. Pat. No. 5,417,819 describes a method for forming a highly reflective surface on aluminum alloys comprising brightening a surface of an aluminum alloy body and then desmutting the freshly brightened surface in a desmutting bath. The desmutting bath comprising 10–100 volume percent nitric acid, 0.60 volume percent sulfuric acid, 0–50 volume percent water, and at least 15 grams per liter of a source of fluoride or bifluoride, such as ammonium fluoride.

U.S. Pat. No. 2,625,468 describes a method for brightening aluminum and aluminum alloy surfaces in a chemical bath while maintaining the effectiveness of the chemical bath. The brightening bath generally comprises a composition of nitric acid, ammonium and hydrofluoric acid. Aluminum parts are embedded in the solution and new solution of the initial composition of the bath is added in a quantity equal to the rate of removal of materials from the bath.

U.S. Pat. No. 3,326,803 describes a finely divided composition suitable for use in aqueous solution at a concentration of about 2.8 to 9.5 weight percent comprising a hydrolyzable acid fluoride salt (e.g., selected from the group consisting of alkali metal bifluorides, ammonium fluoride, sodium silicofluorides and mixtures thereof), oxalic acid, water-soluble methylcellulose, acid-stable, water-soluble wetting agents (e.g., selected from the group consisting of anionic and non-ionic wetting agents, and urea. The composition must be added to water, preferably stirred, and then applied to the metal surface to be brightened.

U.S. Pat. No. 4,496,466 describes a brightening bath for aluminum derived from a wet-process phosphoric acid comprising a majority amount of ortho-phosphoric acid, a subsidiary amount of nitric acid, trace amounts of $SiO_2$, chromium and copper, trace amounts of fluoride ion sufficient to maintain a phosphorous to fluorine ratio in the range of 35 to 1 to 100 to 1, trace amounts of iron, magnesium, and aluminum, less than 500 parts per million of organic substances oxidizable in the presence of nitric acid, and fume inhibitors.

Because of the toxicity and difficulty in handling hydrofluoric acid compositions, phosphoric acid based compositions have found a high level of use. These phosphoric acid systems, including the ones mentioned above, may have a wide range of additional functional materials present in the baths for various specific or general purposes as shown by U.S. Pat. Nos. 2,729,551; 3,094,489; 3,009,849; 3,119,726; and 4,496,466. Some of these patents also describe combination phosphoric acid and nitric acid systems along with beneficial additives. However, purely phosphoric acid or phosphoric acid/nitric acid systems do not have some of the desirable properties of hydrofluoric acid systems. It would therefore be desirable to find hydrofluoric acid based systems which are easily used and have reduced potential for toxic exposure of the persons applying the brightening solution.

SUMMARY OF THE INVENTION

A two-part composition and a method for applying the two parts of the composition or an immediately mixed single part solution to a metal surface to be brightened is described. The two-part composition comprises the materials needed, when diluted and mixed, to provide hydrofluoric acid in solution for use as a brightening composition. When both components are liquids, they may be diluted and mixed as late as in a spray nozzle head and applied to the surface, with the hydrofluoric acid forming immediately, in transit to the surface, and/or on the surface to be brightened. The two components may comprise one liquid and one solid or flowable powder composition or preferably two liquid compositions which can be mixed immediately before, during or immediately after application to a surface to be brightened. One component comprises a stable fluoride providing compound and the other component comprises an acid which when in solution with the fluoride providing compound will generate hydrofluoric acid. The components are preferably mixed on the same day as they are applied, preferably within hours of application, or even within minutes of application to the surface to be cleaned.

DETAILED DESCRIPTION OF THE INVENTION

Figure 1A:
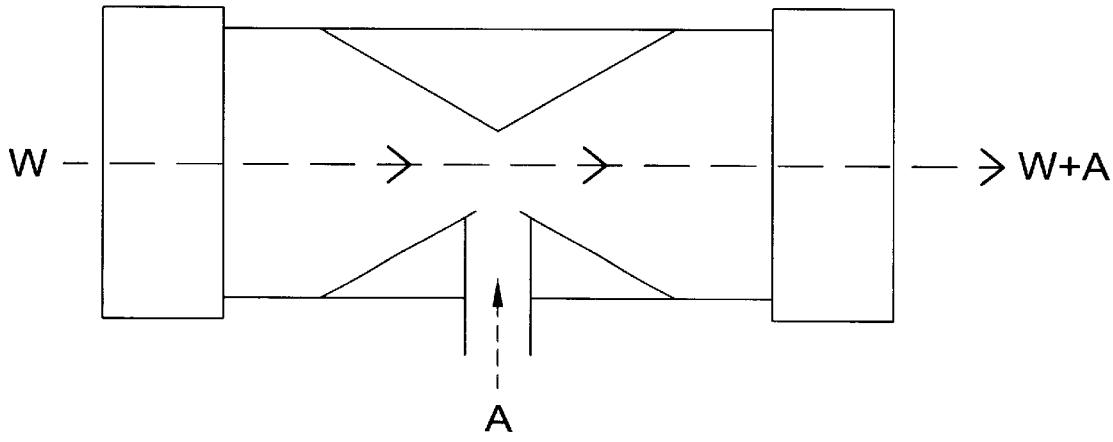
FIG. 1 shows examples of diluting and mixing of one or two components, 1*a*) and 1*b*), respectively, by an eductor.

Two separate components are diluted and mixed into a hydrofluoric acid generating solution or reactive mixture near the location (e.g., around the time) of application to a surface to be brightened. The dilution and mixing of the two components are done on site (near the location of use) before use (e.g., the components are preferably mixed on the same day as they are applied, preferably within hours of application, or even within minutes of application to the surface to be cleaned and even in less than 15 seconds before application), at the time of application to the surface (e.g., in a single head nozzle or multiple head nozzle), or directly on the surface to be brightened (e.g., first one component applied and then the second component applied or both at the same time).

The two essential ingredients which must be present are a fluoride source and an acid solution. The invention may be practiced as simply as a) combining the fluoride source and the acid solution on site before spraying, b) combining the two sources in moving streams immediately before, during or after they pass through a spray nozzle, or c) combining the two components on the surface to be brightened in separate or contemporaneous applications from two separate streams.

The fluoride source should be any water-wettable or water-soluble or acid-soluble fluoride salt or solution, such as for example, potassium fluoride, sodium fluoride, lithium fluoride, ammonium fluoride, ammonium bifluoride, sodium silicofluoride, calcium fluoride, magnesium fluoride, alkali metal fluorides and difluorides generally, alkaline metal fluorides and difluorides generally, and any other compound which forms hydrofluoric acid when combined with sulfuric, nitric, and/or phosphoric acid. The fluoride source may be provided as a solid or flowable powder to be sprayed onto the surface or mixed in a stream with the acid, but is preferably provided as a solution of the fluoride material, such as from 2 to 50% by weight fluoride salt, preferably 5 to 50% by weight fluoride salt, more preferably from 10 to 50% by weight fluoride salt on a weight basis of the solution.

The acid should be a relatively strong acid, and one which in solution with the particularly selected fluoride source will generate hydrofluoric acid from that fluoride source. For example, sulfuric acid, phosphoric acid, sulfinic acid, nitric acid, phosphonic acid, hydrochloric acid, sulfamic acid and mixtures thereof will work. The acid is supplied as an aqueous solution with, for example, from 5 to 85% by weight acid, more often from 10 to 85% by weight acid, and most often between about 15 and 85% by weight acid in the solution.

Additional, optional or preferred components include, chelating agents, surfactants, metal ions, fume suppressants (carbamides, dicyanoamides, triazines 9 such as 2,4,6-triamino-s-triazine), thickening agents (e.g., methylcellulose, hydroxymethylcellulose, synthetic resins, silica), organic acids (such as oxalic acid), sulfonated polymers and the like, and basic materials in the fluoride source component (such as NaOH, KOH, ammonium compounds, and the like). These additives may be used in the relative concentrations appropriate for the particular ingredient and use. For example, the surfactants may be used in amounts of from 0.1 to 20% by weight of the concentrate (more generally from 1 to 12% by weight of the concentrate), and the fume suppressants may be used in amounts of from 0.05 to 7% by weight of the concentrate. The metal ions may be useful at much lower concentrations as for example from 0.1 to 2% by weight of the concentrate, although wider ranges for each component may be selected as needed, without limitation by these generally described ranges. Each of these may be absent from use solutions.

The practice of the invention therefore includes a method of treating a surface of a metal comprising the steps of mixing an aqueous solution comprising a source of fluoride ion and an acid of sufficient strength to form hydrofluoric acid when mixed with the source of fluoride ion, and applying the solution(s), as for example by spraying the solution(s), onto a surface of metal, to be treated. The mixing of the aqueous solution may be performed by mixing a first solution comprising a dissolved, water-soluble source of fluoride ion with a second solution comprising the acid. The method may comprise the steps of separately advancing a first and a second solution towards a mixing zone, mixing the first solution and the second solution within the mixing zone in a continuous flow process to form an active hydrofluoric acid-generating solution, and spraying the active solution onto a surface of metal to be treated. The mixing zone may near a spray nozzle, such as immediately before a spray nozzle. The mixing zone may be a passive mixing zone (e.g., merely a tube into which both solutions are combined while moving towards a nozzle) or an active mixing zone where turbulence, agitation, or shear forces are provided to assure mixing of the solutions. The mixing zone may also be a temporary holding tank, from which the mixed solution is drawn for spraying.

Figure 1B:
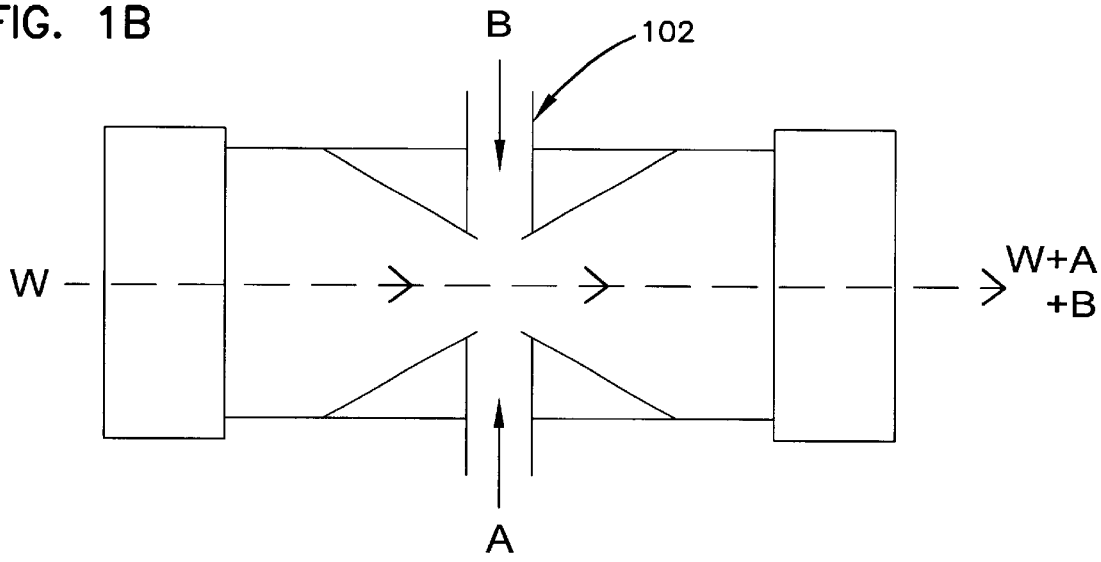

The device for dilution and mixing may be any fluid direction mechanism which can combine at least two streams together before or at the time of emitting solution(s) from the mechanism, such as an injection pump, which pumps the concentrates A and B and injects them into a water stream(s) to make solution A, B or A+B. The device may be an eductor or venturi, which aspirates the concentrates and mixes them into a water stream(s) to make solution A, B or A+B. In the case where A and B are diluted separately, the two streams are combined in the mixing zone before spraying onto a surface to be treated. FIG. I shows examples of how an eductor may be used to dilute and mix one component at a time by aspiration (FIG. 1*a*), or two components simultaneously (FIG. 1*b*). FIGS. 2 (A–D) show a chart of the various ways in which liquid concentrates A and B may be diluted and mixed for application to a surface to be treated. The various mixing methods include:

A) Mixing at least two streams, for example each of streams a) and b) which comprise a source of fluoride ion and a source of an acid of sufficient strength to form hydrofluoric acid when mixed with the source of fluoride ion. These streams may be provided independently with separate streams of water to form diluted solutions of the concentrates A and B, then combining the two diluted solutions into an active ready-for-use (or partially diluted) solution in line or through an optional holding tank, then directing the active solution to an applicator (e.g., a spray nozzle). The mixing device may be an injection pump, an aspirator, a venturi, an eductor or any other convenient mixing device. The product concentration may be further diluted in line or in the optional holding tank.

B) Mixing each of streams a) and b) which comprise a source of fluoride ion and an acid of sufficient strength to form hydrofluoric acid when mixed with the source of fluoride ion, sequentially with a single stream of water to form an active ready-for-use (or partially diluted) solution, optionally storing the active solution in an optional holding tank, then directing the active solution to an applicator (e.g., a spray nozzle). The mixing device may be an injection pump, an aspirator, a venturi or an eductor. The product concentration may be farther diluted in line or in the optional holding tank.

C) Mixing each of streams a) and b) which comprise a source of fluoride ion and an acid of sufficient strength to form hydrofluoric acid when mixed with the source of fluoride ion. These streams may be mixed simultaneously or subsequently with a single stream of water to form an active ready-for-use (or partially diluted) solution, optionally storing the active solution in an optional holding tank, then directing the active solution to an applicator (e.g., a spray nozzle). The mixing device may be an injection pump, an aspirator, a venturi, an eductor or any other mixing device which can combine the necessary materials. The product concentration may be further diluted in line or in the optional holding tank.

D) Mixing each of streams a) and b) which comprise a source of fluoride ion and an acid of sufficient strength to form hydrofluoric acid when mixed with the source of fluoride ion. The streams may be provided independently with separate streams of water to form diluted solutions of the concentrates A and B, then directing the active solutions to two applicators (e.g., a spray nozzle) for simultaneous spraying and mixing on the surface to be treated. The mixing device may be an injection pump, an aspirator, a venturi, an eductor or other mixing device.

Figure 2A:
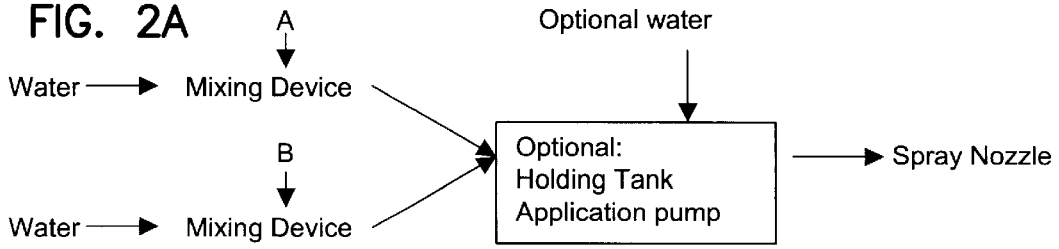
FIGS. 2A through D show a chart of the various ways the solutions A and B may be mixed prior to application to the substrate surface.
Figure 2B:
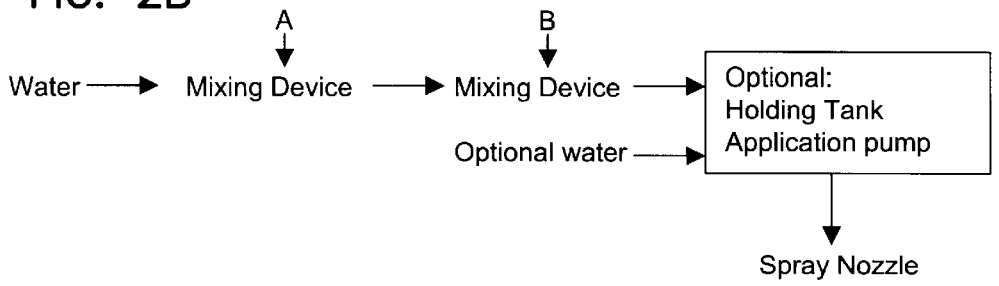
Figure 2C:
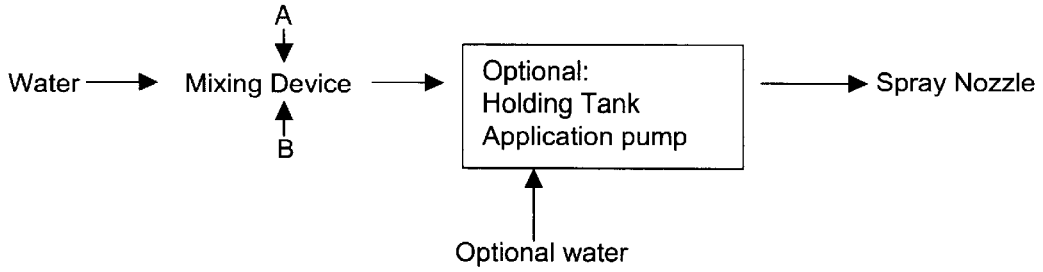
Figure 2D:
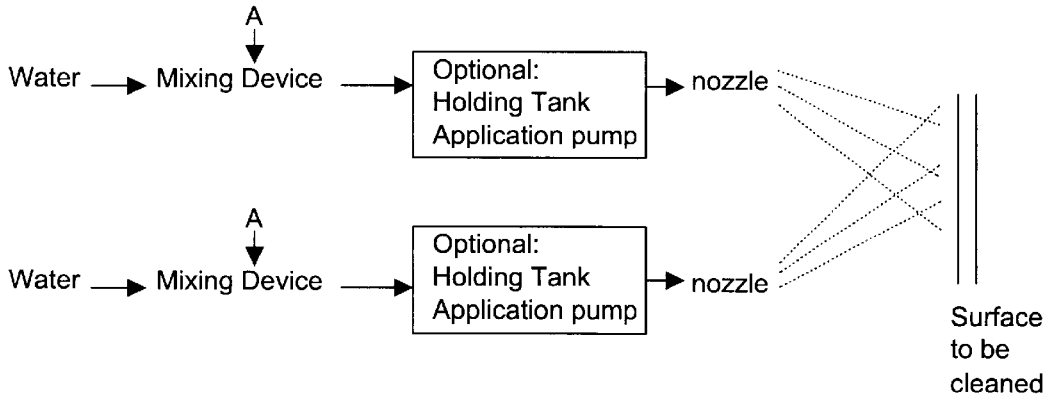
Figure 3:
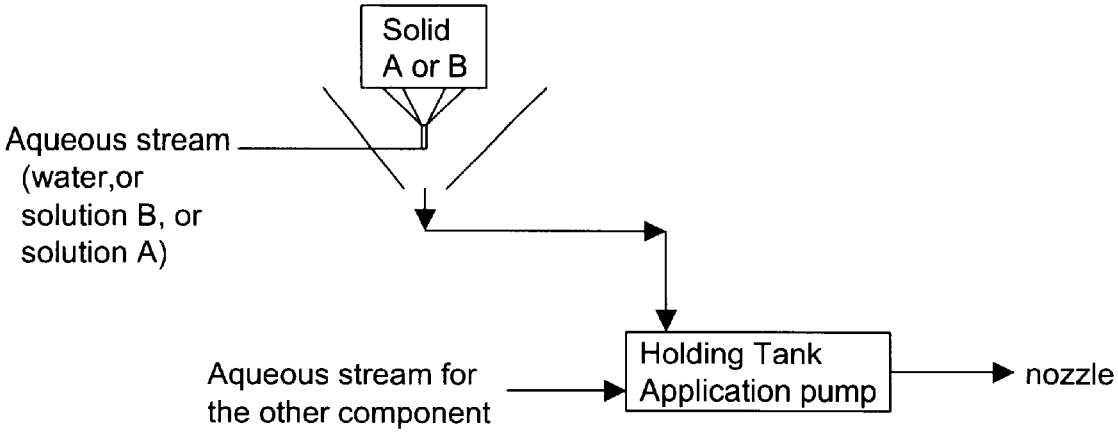
FIG. 3 shows a way to introduce a solid component (A or B) into a liquid stream for dilution and mixing.

When concentrate A or B are solid blocks, the schemes of diluting and mixing shown in FIG. 2A, 2B and 2D may be modified as follows. Instead of injecting or educting a liquid concentrate into an aqueous stream, a nozzle is used to spray an aqueous stream (e.g., water) on a solid concentrate block to form a diluted solution by erosion or dissolution of the solid. This is shown in FIG. 3. This method may be used to form either A or B or both aqueous streams before proceeding toward the holding tank. In this particular format of hydrofluoric acid application, the holding tank may be needed for the solid application (as particles of material may be carried by the aqueous streams. An applicator device such as a nozzle may then be used to apply the solution from the storage tank.

One particularly useful scheme is to form an acid stream by forming an aqueous acid stream, and spraying the acid stream on a solid concentrate comprising a source of fluoride ion, which has a low water solubility but a high acid solubility. This may or may not require a holding tank.

When concentrate A or B or both are powders, the powder component may be either sprayed with an aqueous stream as described above for a solid block (a supporting screen or other support surface may be used here) or the powder may be added directly into the optional holding tank.

The invention may also comprise a kit for the treating of a surface of a metal comprising two separate containers, a first container housing a source of fluoride ion (aqueous solution or a powder), and a second container comprising an aqueous solution of an acid having sufficient strength to form hydrofluoric acid when mixed with the source of fluoride ion, at least one of the said aqueous solutions having a surfactant dissolved therein. The system may be free of phosphoric acid.

These and other aspects of the invention will be further shown and described in the following, non-limiting examples, which are not in any way intended to limit the scope or equivalents useful in the practice of the invention as broadly described.

EXAMPLES

The basic methodology used in these examples selects a 1×3 inch (2.5 by 7.6 cm) aluminum coupon (alloy 5052) and immerses them in a 1.0% NaOH/2.0% Versene 100 (chelant) solution. The coupons are then vigorously rubbed with a soft, non-abrasive sponge, then rinsed before immersing them in an acetone bath. The coupons were then air-dried at room temperature, and their gloss values recorded at a sixty (60) degree angle using four (4) reading each time, for each coupon, in a Gardner (BYK) Micro-TRI-gloss Gloss Meter. Two separate concentrates (concentrates A and B) were prepared as follows, with all units being as percentage by weight:

| Concentrate A | Concentrate B |
|---|---|
| 26.7% $H_2SO_4$<br>5.7% Variquat K-1215 alkoxyalkyl quaternary ammonium (cationic surfactant, bis-[polyethoxy ethanolo]coco ammonium chloride, Witco Chemical Co.),<br>and<br>3.3% NPE 9.5 (Nonyl phenol ethoxylate with an average ethylene oxide content of 9.5 moles) | 17.0% KF |

Solutions A and B were then prepared from Concentrates A and B, respectively, by dilution and mixing into distilled water to give a final concentration of 0.25% of the concentrates.

The data sets used the following compositions as the brightening solution in practicing the method of the examples.

Set (A) comprised Solution (A)

Set (B) comprised Solution (B)

Set (C) comprised an equal parts mixture of Solution (A) and Solution (B). The two solutions were mixed and allowed to equilibrate for 15 minutes before being sprayed as a single stream of solution.

Set (D) was applied as two separate sprayers applied equal amounts of Solutions (A) and (B) with mixing of the two solutions when the two sprays overlapped in the air and collided simultaneously or mixed (on the aluminum coupon surface) with the aluminum coupon surface.

Set (E) was sprayed from a single sprayer, using equal amounts of each of Solution (A) and Solution (B). The mixing was assumed to occur when the two solutions were drawn up symmetrically into a single tube after and concurrently when the solution exited the spray nozzle.

Set (F) used distilled water as a control. It was sprayed, as were all other solutions, using an aerosolizing spout.

After spraying, each coupon was immediately laid horizontally and allowed to lay horizontal for twelve (12) minutes, after which each coupon was immersed twice in hot tap water, and then dunked into acetone. Each coupon was air dried for six (6) minutes. The coupons were then again measured for gloss at a sixty (60) degree angle, and the data recorded. The difference in gloss before and after treatment was then calculated to provide a delta gloss value, reported in the Table as Avg. Delta Gloss. The results evidence the following conclusions. Sets C, D and E which combined Solutions (A) and (B) displayed better results than either individual Set using only one of Solutions (A) or (B) and Set (F) where only water was used.

The performance of Set (D) where the solutions were believed to mix and react on the surface of the coupons was apparently higher than where the solutions were mixed in the nozzle (E) and where the solutions were premixed (C). This is particularly surprising in that one might infer from the respective data between Sets (C) and (E) that there might be some equilibration time desired for complete formation of the hydrofluoric acid from the components, because the equilibrated solution was marginally (possibly within the limits of experimental error) higher than Set (E) where the solutions mixed in the nozzle. The fact that some equilibration time might be desirable, and the fact that mixing of the separate solutions in air, in transit to the coupon surface, and/or on the coupon surface provided statistically significant improved results is definitely surprising. The main objective of safe handling of the active solution by forming the hydrofluoric acid on site shortly before applying the active solution to the surface to be treated is not performed at the expense of the effectiveness of the cleaning solutions.

The data are tabulated in Table 1, showing On-Surface/In-Nozzle HF Generation and Aluminum Brightening.

The combination of solutions described above in the examples, with 5–30% fluoride salt, 15–40% sulfuric acid, and 0% or 0.5% to 10% by weight of organic quaternary ammonium compounds has been found to be particularly useful. The compositions may consist essentially of those two or three basic ingredients and may have levels of other acids (e.g., less than 5%, less than 3%, less than 1% or none) such as nitric acid and phosphoric acid.

In the practice of the present invention, where the mixing of the solutions is described as near the applicator or spray nozzle, this means that there is only a single conveying means (tube or pipe) in place between the point of mixing and the applicator, or that the mixing is actually effected after the spraying (in the air in transit to the surface or on the surface). These and other non-limiting examples of the invention are provided herein.

TABLE 1

On-Surface/In-Nozzle HF Generation and Aluminum Brightening

| | 60 deg Gloss by Gardner BYK Gloss Meter | | | | | |
|---|---|---|---|---|---|---|
| | Before HF treatment | | After HF treatment | | Difference | |
| | Avg (n = 4) | std dev (n = 4) | Avg (n = 4) | std dev (n = 4) | Gloss (n = 4) | Average |
| (Solution A only) | | | | | | 3.28 |
| Sulfuric + Surfs | | | | | | |
| A1 | 182.9 | 5.8 | 189.6 | 4.4 | 6.7 | |
| A2 | 159.7 | 2.6 | 160.6 | 3.2 | 0.9 | |
| A3 | 142 | 4 | 142.6 | 4.8 | 0.6 | |
| A4 | 158.8 | 1 | 163.5 | 1.2 | 4.7 | |
| A5 | 137 | 5.8 | 140.5 | 4.6 | 3.5 | |
| (Solution B only) | | | | | | −1.84 |
| KF | | | | | | |
| B1 | 153.9 | 3.2 | 156 | 3.8 | 2.1 | |
| B2 | 156.6 | 6.4 | 152.3 | 5 | −4.3 | |
| B3 | 171.7 | 6.4 | 169 | 8 | −2.7 | |
| B4 | 156.6 | 6.6 | 150.8 | 7.2 | −5.8 | |
| B5 | 170.4 | 3.4 | 171.9 | 4.8 | 1.5 | |
| A + B Pre-Equil. | | | | | | 10.73 |
| C1 | 159.7 | 1.4 | 170.7 | 1 | 11 | |
| C2 | 163.7 | 2.2 | 170.2 | 1.6 | 6.5 | |
| C4 | 139.5 | 3.2 | 151.7 | 2.8 | 12.2 | |
| C5 | 150.7 | 1.6 | 163.9 | 0.8 | 13.2 | |
| A + B On Surface Mixing | | | | | | 12.60 |
| D1 | 150 | 5.4 | 161.2 | 5.4 | 11.2 | |
| D2 | 145.7 | 5 | 159.5 | 5 | 13.8 | |
| D3 | 163 | 7.4 | 182 | 5.8 | 19 | |
| D4 | 137.9 | 2.4 | 155.1 | 1.6 | 17.2 | |
| D5 | 164.8 | 1.2 | 166.6 | 2 | 1.8 | |
| A + B in-nozzle Mixing | | | | | | 10.53 |
| E1 | 172.6 | 2.6 | 178.6 | 2 | 6 | |
| E2 | 155.1 | 2.4 | 162.2 | 1.2 | 7.1 | |
| E3 | 166 | 4.8 | 184.5 | 1 | 18.5 | |
| Water Control | | | | | | 1.36 |
| F1 | 176.5 | 2.2 | 180.1 | 6.2 | 3.6 | |

TABLE 1-continued

On-Surface/In-Nozzle HF Generation and Aluminum Brightening

| | 60 deg Gloss by Gardner BYK Gloss Meter | | | | | |
|---|---|---|---|---|---|---|
| | Before HF treatment | | After HF treatment | | Difference | |
| | Avg (n = 4) | std dev (n = 4) | Avg (n = 4) | std dev (n = 4) | Gloss (n = 4) | Average |
| F2 | 130.6 | 6.4 | 127.4 | 5 | −3.2 | |
| F3 | 158.4 | 8.6 | 163.3 | 3 | 4.9 | |
| F4 | 145.3 | 6.4 | 144.3 | 6.6 | −1 | |
| F5 | 167.4 | 4.8 | 169.9 | 2.2 | 2.5 | |

Note:
See text for contents of Solutions A and B.

What we claim:

1. A method of treating a surface of a metal comprising the steps of:

(A) preparing at the site of use a solution comprising a) a source of fluoride ion comprising a water-soluble or an acid-soluble fluoride salt and b) an acid comprising at least one of sulfuric acid, nitric acid, phosphoric acid, hydrochloric acid, sulfamic acid, sulfinic acid, and mixtures thereof to form aqueous hydrofluoric acid when mixed with the source of fluoride ion; wherein the step of preparing comprises steps of:

(i) diluting the source of fluoride ion with water to provide a diluted solution of fluoride ion, and diluting the acid with water to provide a diluted solution of acid;

(ii) simultaneously spraying the diluted solution of fluoride ion through a first applicator and onto the surface of a metal and spraying the diluted solution of acid through a second applicator onto the surface of a metal to provide mixing of the solution of fluoride ion and the solution of acid to form aqueous hydrofluoric acid.

2. A method according to claim 1, wherein the source of fluoride ion comprises at least one of alkali metal fluorides, alkaline metal fluorides, and ammonium bifluoride.

3. A method according to claim 1, wherein the solution of fluoride ion and the solution of acid are mixed in air, in transit toward the surface to be treated.

4. The method according to claim 1, wherein the solution of fluoride ion comprises from about 0.01% by weight to about 1.0% by weight fluoride salt, and the solution of acid comprises between about 0.02% by weight to about 2.0% by weight acid.

5. A method according to claim 1, wherein the solution of fluoride ion comprises between about 0.01% by weight to about 0.5% by weight fluoride salt, and the solution of acid comprises between about 0.05% by weight to about 1.0% by weight acid.

6. A method according to claim 1, wherein at least one of the solution of fluoride ion and the solution of acid comprises a surfactant in an amount of between about 0.001% by weight to about 0.2% by weight.

7. A method according to claim 1, wherein at least one of the solution of fluoride ion and the solution of acid comprises a quaternary ammonium compound in an amount of between about 0.001% by weight to about 0.2% by weight.

8. A method according to claim 1, wherein at least one of the solution of fluoride ion and the solution of acid comprises a surfactant in an amount of between about 0.001% by weight to about 0.2% by weight.

9. A method according to claim 1, wherein the surface of a metal comprises the surface of a metal provided on a vehicle selected from at least one of a car and a truck.

* * * * *

UNITED STATES PATENT AND TRADEMARK OFFICE

CERTIFICATE OF CORRECTION

PATENT NO. : 6,440,224 B1
DATED : August 27, 2002
INVENTOR(S) : Wei et al.

It is certified that error appears in the above-identified patent and that said Letters Patent is hereby corrected as shown below:

Column 4,
Line 7, “triazines 9 such as” should read -- triazines such as --
Line 59, “FIG. I” should read -- FIG. 1 --

Column 6,
Line 26, “them” should read -- it --

Column 7,
Line 17, “Table as” should read -- Table 1 as --

Column 8,
Table 1, column 4 header: “Gloss” should read -- Avg. Delta Gloss --

Signed and Sealed this

Fifteenth Day of July, 2003

JAMES E. ROGAN
*Director of the United States Patent and Trademark Office*